US005881788A

United States Patent [19]

Hersh et al.

[11] Patent Number: 5,881,788

[45] Date of Patent: Mar. 16, 1999

[54] HANDBAG HAVING CREDIT CARD HOLDER INSERT

[75] Inventors: Ahron Hersh, Brooklyn, N.Y.; Chi Yueh Chen, Taipei, Taiwan

[73] Assignee: Rosetti Handbags and Accessories, Ltd., New York, N.Y.

[21] Appl. No.: 726,086

[22] Filed: Oct. 4, 1996

[51] Int. Cl.[6] ..... A45C 3/06

[52] U.S. Cl. ..... 150/116; 150/148

[58] Field of Search ..... 150/116, 147, 150/148

[56] References Cited

U.S. PATENT DOCUMENTS

| | | | |
|---|---|---|---|
| 1,538,518 | 5/1925 | Marymount . | |
| 1,564,967 | 12/1925 | Kulick . | |
| 1,791,703 | 2/1931 | Benendict et al. | 150/147 |
| 1,863,270 | 6/1932 | Goldsmith . | |
| 1,998,798 | 4/1935 | Welch . | |
| 2,061,293 | 11/1936 | Stember . | |
| 2,270,775 | 1/1942 | Stember | 150/116 X |
| 2,399,898 | 5/1946 | Stember | 150/116 X |
| 2,428,267 | 9/1947 | Doppelt | 150/116 X |

*Primary Examiner*—Jes F. Pascua
*Attorney, Agent, or Firm*—Abelman, Frayne & Schwab

[57] ABSTRACT

A handbag is disclosed having an enclosure which defines a major compartment for receiving and retaining articles, a credit card holder for holding at least one credit card, a minor compartment defined within the major compartment for reception of the credit card holder, and a connecting member for attaching the credit card holder with respect to the minor compartment in a manner which permits insertion of the credit card holder into the minor compartment and withdrawal of the credit card holder upwardly with respect to the minor compartment up to a predetermined distance as limited by the connecting member. When the credit card holder is moved upwardly, such movement provides user access to the credit cards, while preventing outward movement of the credit card holder from the minor compartment a distance greater than said predetermined distance.

23 Claims, 5 Drawing Sheets

46
64
76a
68e
66e
86
52
50a
48a
88
76b
68d
48a
66d
90
74b
50a
50
48
92
74b
68c
66c
50a
48a
66b
68b
48a
50a
68
66
76
84
68a
74
82
66a
58
60
80
72
78
70
62
54

HANDBAG HAVING CREDIT CARD HOLDER INSERT

BACKGROUND OF THE INVENTION

1. Field of the Invention

This invention relates to handbags and other portable personal carrying containers, and more particularly, to a handbag having a separate compartment for reception and retention of a credit card holder, the credit card holder being permanently attached to the handbag to prevent separation movement relative to the separate compartment in excess of a predetermined distance.

2. Background of Related Art

The structure and usage of handbags, pocketbooks and other portable carrying containers is well known. Handbags and luggage are commonly constructed of one or more interior compartments configured to retain cosmetics, toiletries and other items for ready access by the user. In such known structures, handbags often contain inner distinct compartments for reception of articles or other items.

In handbags, a separate compartment for containing a bill fold, a coin purse, or the like has often been incorporated by structuring the compartment in either a permanently open condition or with a latching mechanism which permits closure of the compartment. Some examples of these types of structures can also be found in the patent literature.

With increasing use of credit cards, consumers have found the need to carry an increasing number of credit cards on a regular basis. In order to facilitate carrying such credit cards, wallet and handbag manufacturers have provided a number of vehicles for the consumers use whereby credit cards can be inserted into pocket-like compartments or the like for storage and ready access.

The increasing use of such credit cards has also given rise to an increasing loss of the credit cards either by accidental cause or theft. Thus, in the case of a handbag, although an individually separable container for carrying credit cards may be provided by the manufacturer, the credit card holder may become separated and be lost either through inadvertence or by theft when the consumer removes it from the carrying container for use of a credit card. Accordingly, there is a need for a carrying container having provisions for storage and retention of credit cards with means to prevent permanent physical separation of the credit cards from the container more than a predetermined distance.

The prior art includes a number of examples of handbags and the like having separate storage containers or devices for containing articles. For example, U.S. Pat. No. 1,538,518 to Marymount relates to a pocketbook or handbag having an identification card holder and mirror attached to the handbag by a suitable band 29. Marymount also discloses a secret pocket 16 attached to a flexible band 17. U.S. Pat. No. 1,564,967 to Kulick discloses a handbag having a bill folder 17 connected within a compartment by a connecting strip 22. U.S. Pat. No. 1,863,270 to Goldsmith discloses a handbag having a safety pocket 23 formed in the central portion. U.S. Pat. No. 1,998,798 to Welch discloses a handbag having a coin purse 19 connected with the handbag by a rigid connecting member 24. U.S. Pat. No. 2,061,293 to Stember relates to a ladies' handbag having a billfold 17 connected to the handbag by a connecting member 21.

Although the portable personal carrying containers disclosed in the prior art relate generally to handbags having items such as identification card holders, mirrors, coin purses, bill folders or the like associated with the handbag in some fashion, there is no disclosure of a handbag adapted for permanent reception of a device capable of holding at least one credit card, wherein a safe and secure place is provided within the handbag for storage of credit cards in a manner where they are readily accessed by the user, and which also facilitates such storage in a manner which prevents loss by theft or otherwise of the credit cards from the handbag and the user. Accordingly, the present invention is directed to a handbag which avoids the problems prevalent with known handbags.

SUMMARY OF THE INVENTION

The present invention is directed to a handbag which comprises an enclosure defining a major compartment for receiving and retaining articles, means for holding at least one credit card, a minor compartment within the major compartment for reception of the credit card holding means. Means is also provided for attaching the credit card holding means with respect to the minor compartment in a manner which permits insertion of the credit card holding means into the minor compartment and withdrawing movement of the credit card holding means with respect to the minor compartment up to a predetermined distance to provide user access to the credit card holding means. Thus, outward movement of the credit card holding means from the minor compartment a distance greater than the predetermined distance. The enclosure comprises opposed front and rear wall portions, opposed side wall portions, and respective bottom wall portions. The minor compartment is preferably formed by a pair of wall portions positioned adjacent each other in face-to-face relationship and extending between the opposed side wall portions. Further, credit card holding means is preferably structured to receive and retain a plurality of credit cards.

In a preferred embodiment, the means to attach the credit card holding means to the minor compartment comprises a material fabric connector attached at a first end portion to a lower portion of said credit card holding means and at a second end portion to a lower marginal portion of the minor compartment. Furthermore, the credit card holding means preferably comprises a credit card holder having a pair of panels positioned in face-to-face relation and attached to each other along marginal portions thereof, each panel defining a plurality of slits for reception of a corresponding plurality of credit cards. Each of the slits is associated with a fabric pocket extending therebelow for reception and support of at least a portion of a respective credit card, and each of said panels of said credit card holder comprises a synthetic or natural leather material.

In the present handbag, each adjacent pair of slits of the panels of the credit card holder defines a corresponding synthetic or natural leather material strip which separate the credit card from each other. More particularly, the panels of the credit card holder each comprise at least five adjacent parallel material strips defined by four of said parallel slits, each adjacent pair of the material strips having associated therewith one of the fabric pockets.

In the handbag disclosed herein, each of the panels are stitched together along the marginal edge portions thereof and each fabric pocket is formed of a material fabric portion attached to rear surface portions of adjacent material strips. The pocket is preferably comprised of a fabric liner material and extends downwardly from a rear surface portion of a material strip and is folded to extend upwardly to a rear surface portion of the next lower material strip to form the credit card receiving pocket.

The material fabric connector is attached to the panels by stitches at a lower marginal end portion thereof, and the connector is attached at the opposite end to a lower portion of the minor compartment by stitches. Furthermore, the minor compartment subdivides the major compartment into two separate compartments for receiving and retaining articles.

The handbag preferably includes a closure flap extending from an upper marginal portion of the rear wall and dimensioned for selective movement over an access opening of the major compartment, the flap having means such as a magnetic or mechanical clasp for releasable attachment thereof to an opposite wall portion so as to protectively cover the access opening of the major compartment. A second compartment structured and adapted for reception of articles may be attached to the front wall portion of the enclosure.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
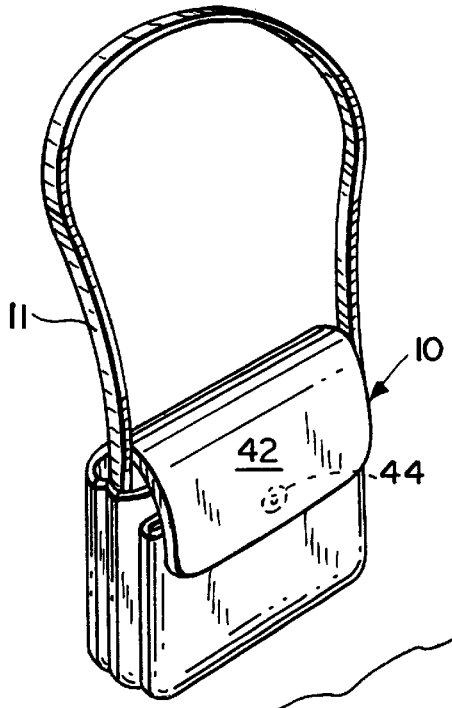
FIG. 1 is a perspective view of a handbag constructed according to the present invention.

Referring now in detail to the drawings wherein like reference numerals identify similar structural elements of the invention disclosed herein, there is illustrated in FIG. 1 a handbag constructed in accordance with a preferred embodiment of the subject invention and designated generally by reference numeral 10. The handbag will normally be made of natural or synthetic leather. However, suitable alternative materials such as cloth or cloth-like materials, with appropriate supportive rigid or semi-rigid backing materials may be used. In each instance, the materials utilized are connected to each other by known techniques, such as stitches, adhesives, or combinations thereof. Optional shoulder or carry strap 11 is shown.

The construction of handbag 10 is unique among those known in the art in that the handbag includes a major compartment in which is contained a minor compartment for receiving and supporting a credit card holder in a particular manner as will be described hereinbelow.

Figure 2:
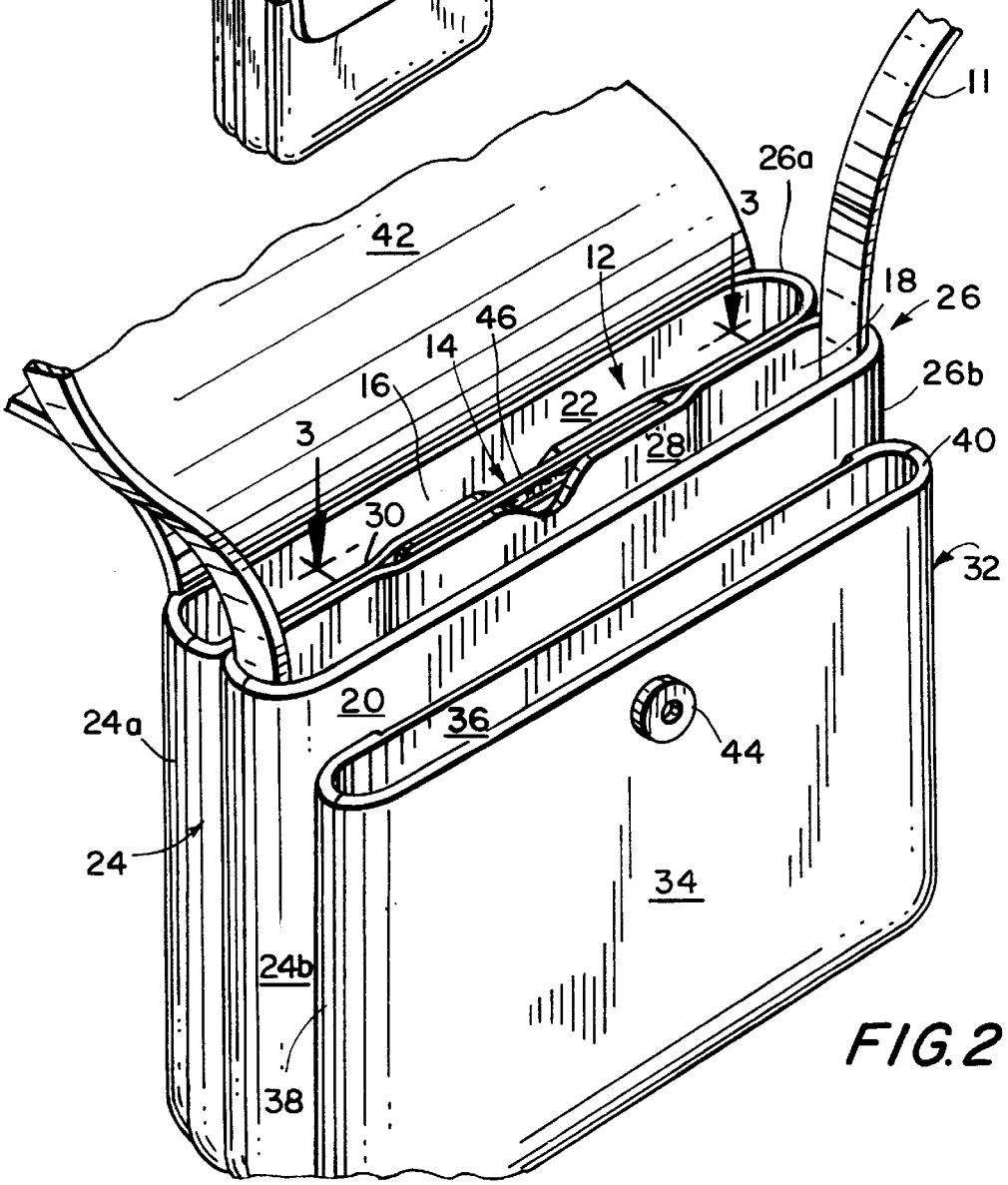
FIG. 2 is a perspective view of a handbag shown in FIG. 1 with the closure flap in the open position and partially broken away, showing the major compartment.

Referring to FIG. 2, handbag 10 defines a major compartment 12 for reception and retention of articles. Major compartment 12 is in turn subdivided by minor compartment 14 into two separate and distinct subcompartments including rear subcompartment 16 and front subcompartment 18. These subcompartments 16, 18 may be used separately for reception and retention of articles.

Figure 4:
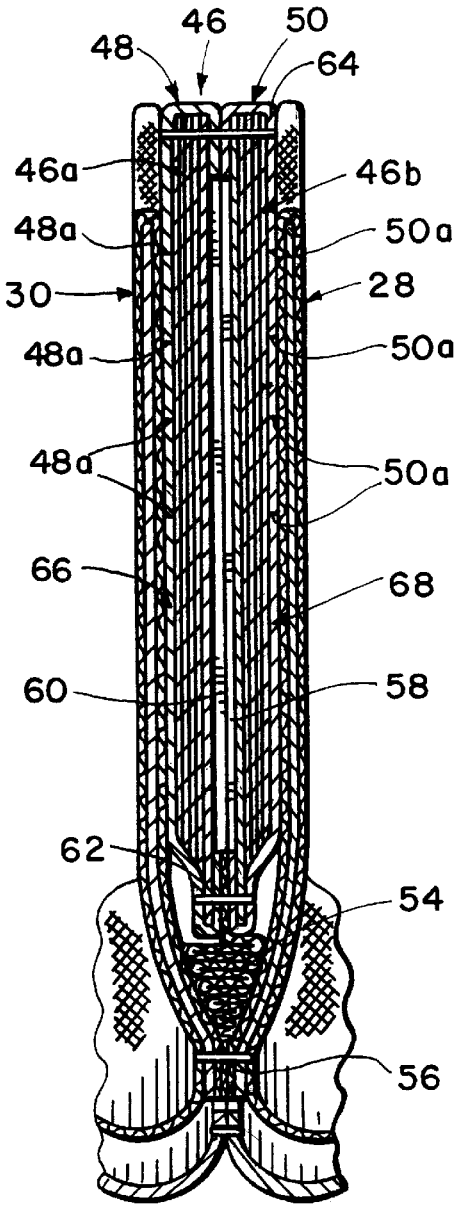
FIG. 4 is a cross-sectional view of the minor compartment and credit card holder positioned therein taken along lines 4—4 of FIG. 3.

Referring to FIG. 2 in conjunction with FIG. 4, major compartment 12 is defined by front wall 20, rear wall 22, side walls 24, 26, and bottom wall 29, best shown in FIG. 4. In the embodiment shown, minor compartment 14 is actually formed by panels 28, 30 as shown, which are actually continuous with front side wall portions 24*b*, 26*b* and rear side wall portions 24*a*, 26*a*, respectively. However, panels 28, 30 may alternatively be in the form of separate panels individually attached to side wall panels, per se.

As shown, the various structural compartments are assembled by stitches and/or adhesive, or combinations thereof. Optional front compartment 32 is attached to front wall 20 and is formed of front wall 34, rear wall 36 and side walls 38, 40. Cover flap 42 is attached to rear wall 22 and is flexible for movement between the open position shown in FIG. 1 and the closed position in FIG. 2 whereby flap 42 is secured by magnetic or other type clasp 44. Alternatively, the side wall portions and bottom wall portions may be in the form of flat leather panels suitably attached to the front, rear and bottom wall portions in a known manner and flap 42 may be hinged.

Figure 3:
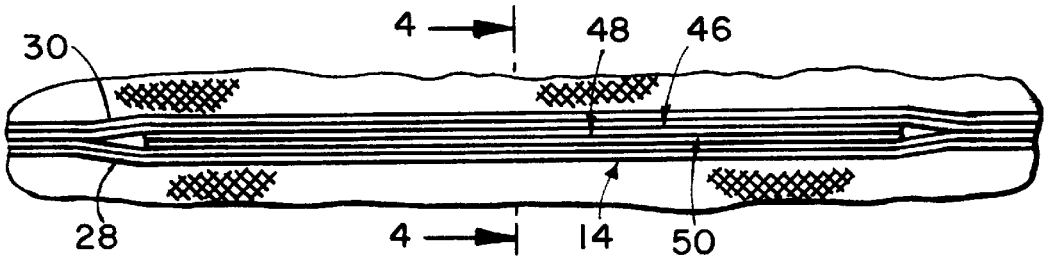
FIG. 3 is a top view of the minor compartment within the major compartment of the handbag taken along lines 3—3 of FIG. 2.

Referring again to FIG. 2 in conjunction with FIGS. 3 and 4, minor compartment 14 is formed by a pair of panels 28, 30 of a suitably rigid material. In the embodiment shown, panels 28, 30 are constructed of a semirigid cardboard backing covered by a complementary fabric material. Alternatively, these panels may be made of natural or synthetic leather, used either as a panel per se, or used as a covering for a semi-rigid cardboard panel. Panels 28, 30 are attached together by stitches, but are left separate from each other in the mid-region to define minor compartment 14 which is structured to receive and retain credit card holder 46 in snug relation as shown.

Figure 5:
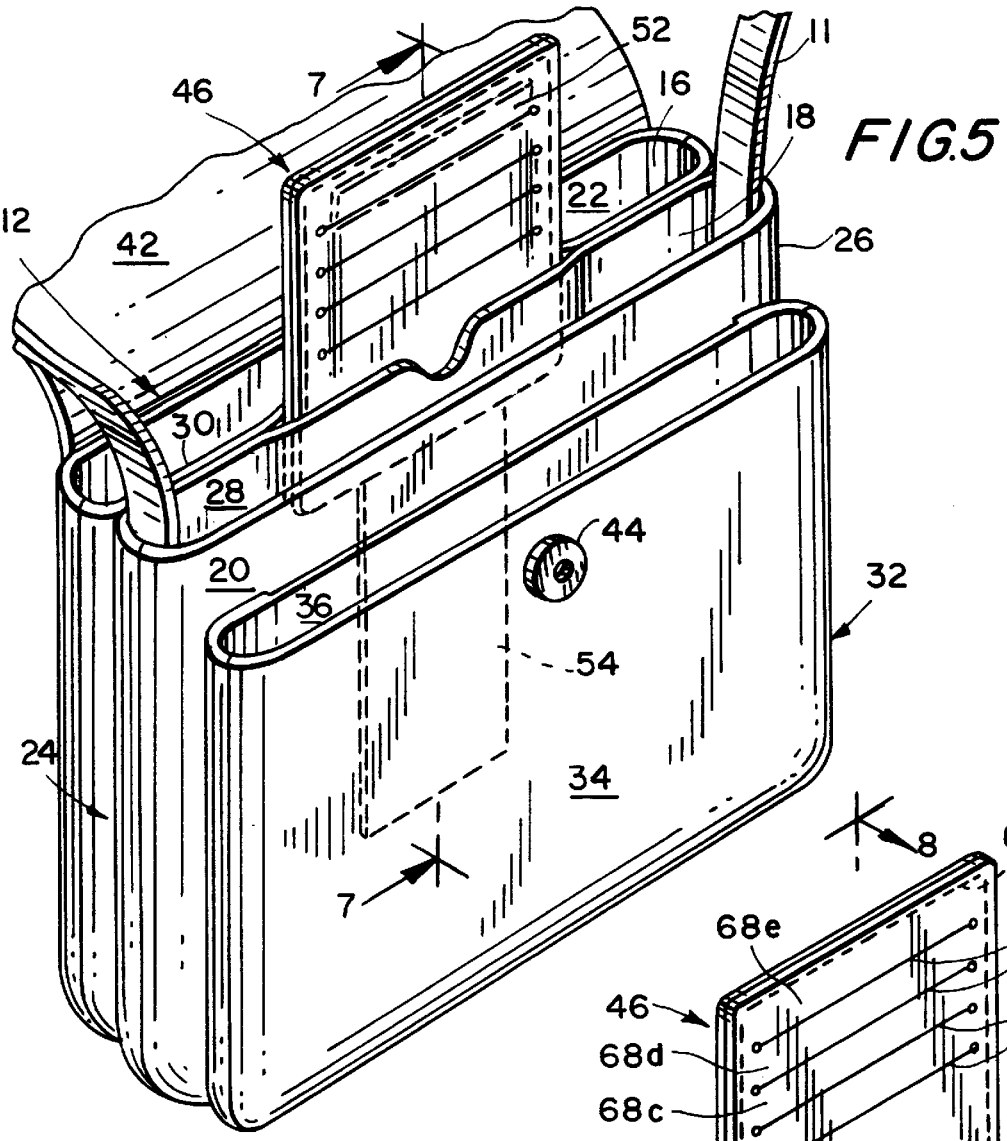
FIG. 5 is a perspective view similar to FIG. 2 with the credit card holder withdrawn with respect to the minor compartment at least sufficient to provide access to the user of all credit cards retained in the holder.
Figure 6:
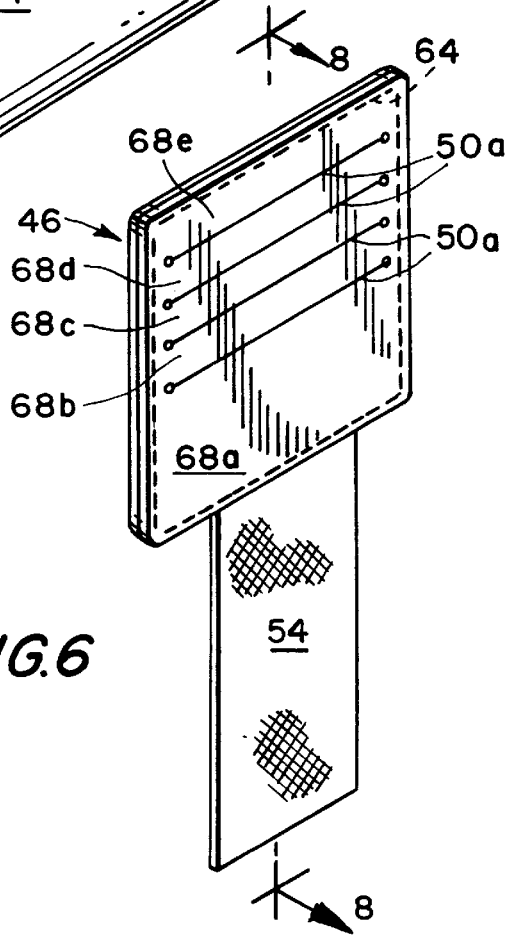
FIG. 6 is a perspective view of the credit card holder and connective ribbon removed from the handbag of FIG. 5 for illustration purposes.
Figure 7:
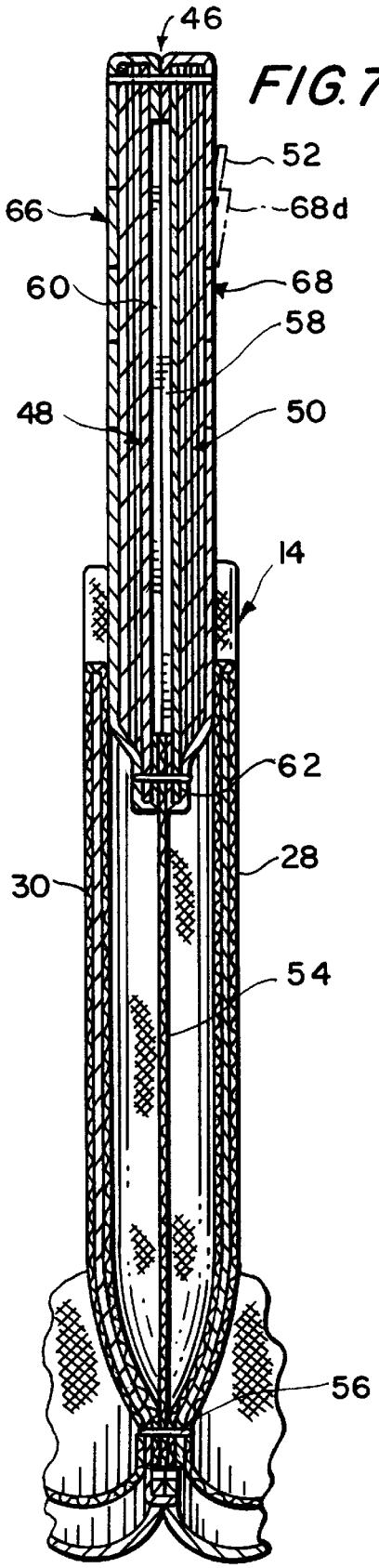
FIG. 7 is a cross-sectional view taken along lines 7—7 of FIG. 5, illustrating in cross-section the credit card holder withdrawn with respect to the minor compartment the maximum distance according to one embodiment of the invention.
Figure 8:
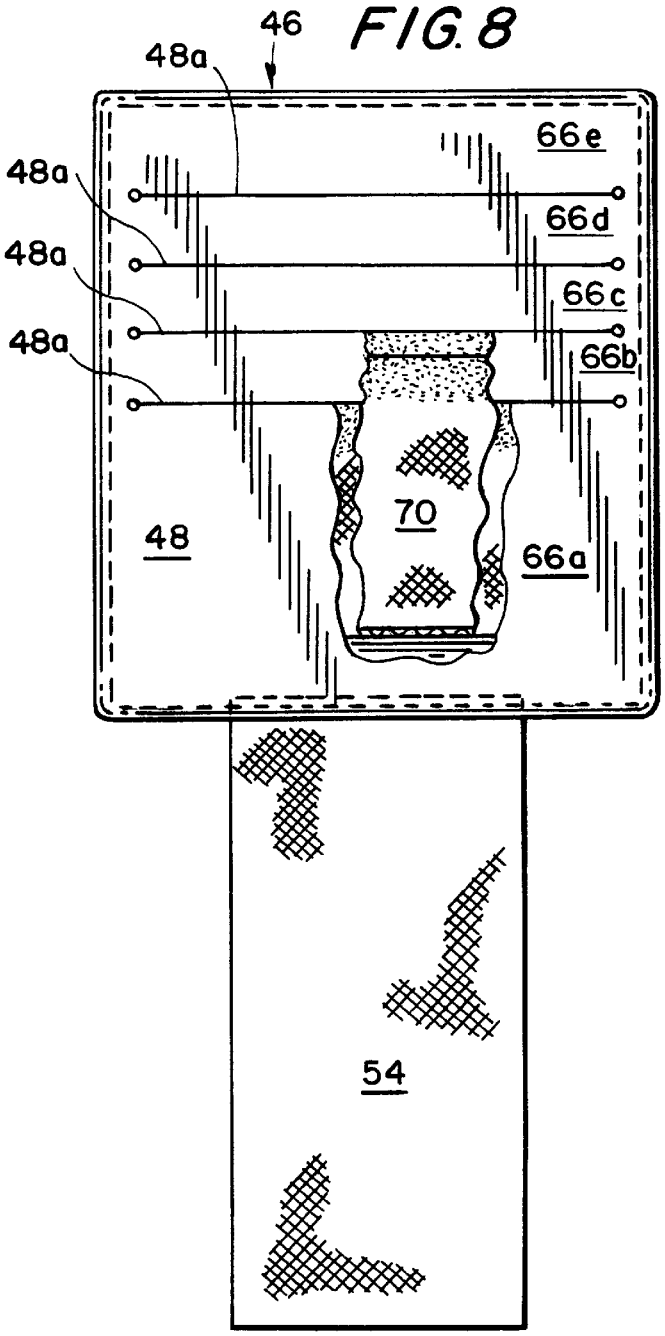
FIG. 8 is a rear elevational view of the credit card holder and connective ribbon taken along lines 8—8 of FIG. 6, with portions of the credit card holder broken away to illustrate the construction.
Figure 9:
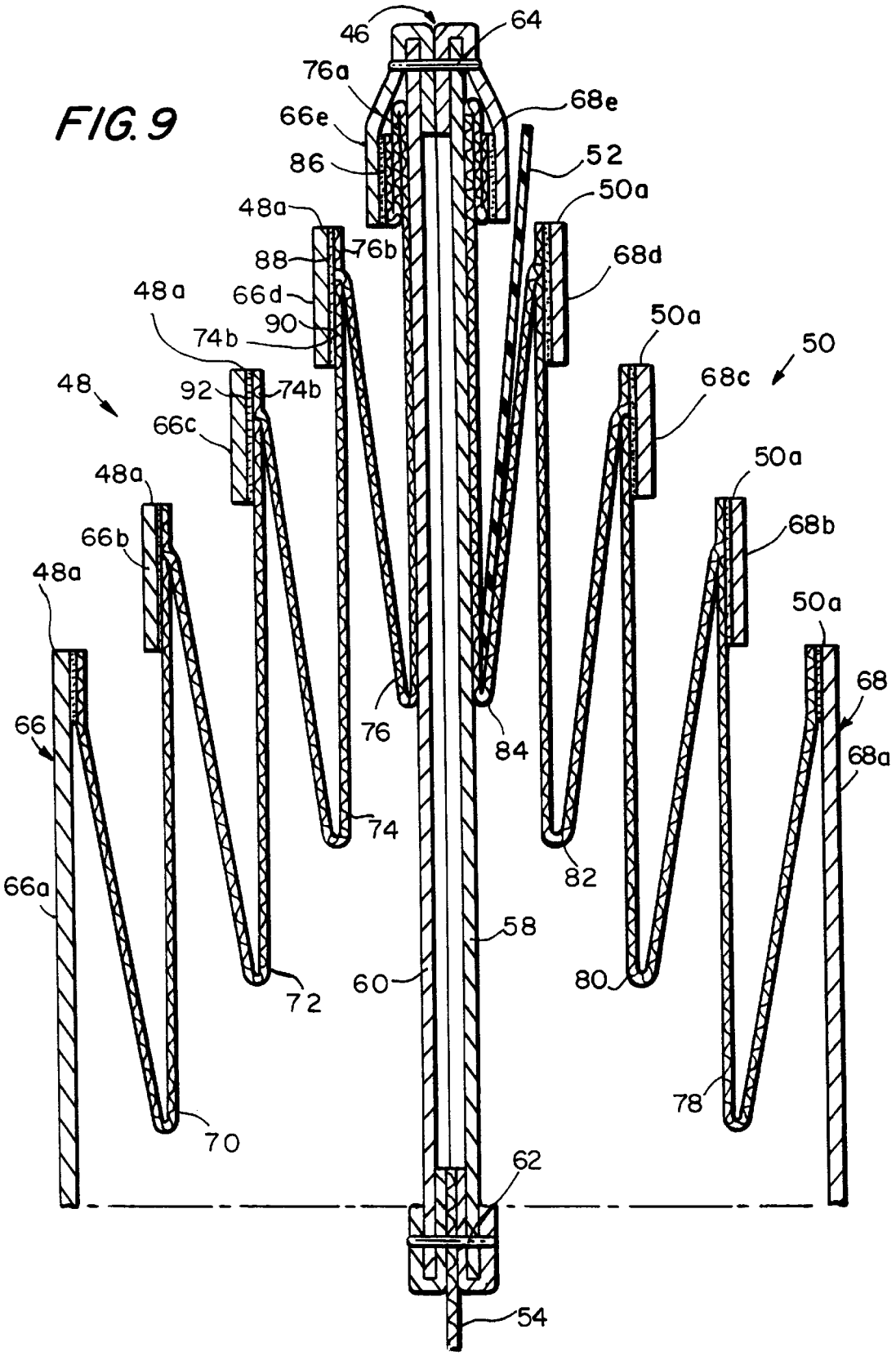
FIG. 9 is a cross-sectional view of the credit card holder of FIGS. 7 and 8 with the individual constructional compartments thereof separated from the central panels for illustrative purposes only.

Referring to FIG. 2 in conjunction with FIGS. 3–8, credit card holder 46 is formed of a combination of rigid or semi-rigid panels 48, 50, each of which contains a plurality of slits 48*a*, 50*a*, respectively, to receive a corresponding plurality of credit cards, shown typically for illustration purposes at 52 in FIGS. 5, 7 and 9. The credit card holder 46 is attached to minor compartment 14 by fabric ribbon 54 attached to the lower edge of compartment 14 by stitches 56. As viewed in FIGS. 2 and 8, the credit card holder 46 has a widthwise dimension (i.e., as measured from left to right) less than the corresponding widthwise dimension (i.e., as measured from left to right) of the major compartment 12.

The upper end of ribbon 54 is attached to the lower marginal portion of credit card holder 46 as best shown in FIG. 6 by stitches 62. Thus by selecting the length of fabric ribbon 54, the amount of upward movement permitted credit card holder 46 with respect to minor compartment 14 can be selectively limited as seen for example in FIGS. 5 and 7.

Connective ribbon 54 is preferably made of a fabric liner material such as silk, nylon, acetate or the like, which provides flexibility and strength, yet can be folded in compact fashion as shown in FIG. 4.

Preferably, when the ribbon 54 is dimensioned relative to the handbag 10 as shown, the credit card holder 46 is movable only between the positions shown in FIGS. 2, 5 and 7, respectively. In FIG. 2, the credit card holder 46 is snugly contained substantially entirely within minor compartment 14, whereas in the withdrawn position shown in FIGS. 5 and 7, only about 25 percent of the credit card holder 46 remains within the minor compartment 14, thus providing user access to the credit cards.

As noted, it will be appreciated that the limitations placed upon the movement of the credit card holder 46 as described, provide ready access to the user of the credit card holder and the credit cards contained therein, while preventing total separation of the credit card and credit cards either by inadvertence or theft. However, it should be understood that the relative dimensions may be varied to accommodate individual needs or tastes. For example, the ribbon 54 may be made shorter or longer as desired, whereby the position of the credit card holder 46 will otherwise be determined. Also, credit card holder 46 can be alternatively structured as a checkbook holder, a purse or wallet, or the like (not shown), having the structure capable of holding one or more credit cards similar to the manner shown.

Referring now to FIGS. 8 and 9, the construction of the credit card holder 46 will be described. For convenience of illustration, the cover materials are shown in enlarged separated sections, whereas they are actually part of the same material layer. Credit card holder 46 is formed of front panel 50 and rear panel 48 constructed as shown in FIG. 9. Preferably, a pair of relatively rigid backing panels 58, 60 are attached in face-to-face relation as shown in FIG. 9 and provided with natural or synthetic leather cover layers as shown to form front panel 50 and rear panel 48, respectively. Each cover layer is secured in position to panels 58, 60 by stitches 62, 64. Panels 58, 60 may be formed of any relatively rigid or semi-rigid backing material such as cardboard, vinyl, or the like. Alternatively, panels 58, 60 may also be leather.

Each leather cover layer 66, 68 has a plurality of slits 48*a*, 50*a*, as described previously, which define five separate parallel strips of leather material on each side, namely strips 66*a*, 66*b*, 66*c*, 66*d*, 66*e* on the front side and strips 68*a*, 68*b*, 68*c*, 68*d* and 68*e* on the rear side. In addition, a plurality of credit card pockets 70, 72, 74, 76, 78, 80, 82, 84 are formed as shown of a convenient flexible liner material such as woven silk or other similar synthetic material such as acetate or nylon. Typical construction of these pockets may be described for example with reference to pockets 76 and 74.

Pocket 76 is formed of a liner material such as silk, nylon, acetate, etc., which is folded twice upon itself at 76*a* and positioned and held between panel 60 and leather strip 66*e* by an adhesive layer 86. The fabric extends downwardly and then turns upwardly to form pocket 76 with upper marginal portion 76*b* being attached to the upper rear surface portion of leather strip 66*d* by adhesive layer 88.

The next adjacent pocket 74 is formed by attaching upper marginal portion 74*b* of the pocket liner material to a lower rear surface portion of leather strip 66*d* by adhesive layer 90. The opposite upper marginal portion 74*b* of pocket 74 is attached to the upper rear surface portion of next adjacent leather strip 66*c* by adhesive layer 92. The remaining credit card pockets are similarly constructed as shown in the drawings at FIG. 9.

Credit card holder 46 constructed as described is attached to the minor compartment 14 by connective ribbon 54 such that when the major compartment 12 is exposed by lifting cover flap 42 the user may simply grasp credit holder 46 with the thumb and fore-finger, and lift it out of compartment 14 thereby providing access to major portions of both front and rear credit card holder panels. Thus, in the embodiment shown up to eight credit cards may be held in the credit card holder, with four cards on each side. However, as noted, the credit card holder may be alternatively constructed, such as being part of another type of container such as a checkbook holder, a purse or wallet, etc., with provision on at least one side thereof to hold a credit card. As noted, the upward movement of the credit card holder relative to minor compartment 14 is limited by the lengthwise direction of fabric ribbon 54.

Although the subject invention has been described with reference to preferred embodiments, it will be readily apparent to those of ordinary skill in the art to which it appertains that changes and modifications may be made thereto without departing from the spirit or scope of the subject invention as defined by the appended claims.

What is claimed is:

1. A handbag which comprises an enclosure defining a major compartment for receiving and retaining articles, means for holding at least one credit card, said credit card holding means having a widthwise dimension less than a corresponding dimension of said major compartment, a minor compartment within said major compartment for reception of said credit card holding means, said minor compartment being formed by at least two panels positioned in opposed face-to-face relation and attached at least along two upper marginal portions, and unattached along a marginal portion positioned between said first mentioned two upper marginal portions for reception of said credit card holding means in snug relation, and means for attaching said credit card holding means with respect to said minor compartment in a manner which permits insertion of said credit card holding means into said minor compartment and withdrawing movement of said credit card holding means from said minor compartment up to a predetermined distance to provide user access to said credit card holding means, while preventing outward movement of said credit card holding means with respect to said minor compartment a distance greater than said predetermined distance, said attaching means for said credit card holding means having a widthwise dimension less than the corresponding dimension of said credit card holding means.

2. The handbag according to claim 1 wherein said enclosure comprises opposed front and rear wall portions, opposed side wall portions, and respective bottom wall portion.

3. The handbag according to claim 2 wherein said minor compartment is formed by a pair of panels positioned adjacent each other in face-to-face relationship and extending between said opposed side wall portions.

4. The handbag according to claim 3 wherein said credit card holding means is structured to receive and retain a plurality of credit cards.

5. The handbag according to claim 4 wherein said means to attach said credit card holding means to said minor compartment comprises a fabric connector attached at a first end portion to a lower portion of said credit card holding means and at a second end portion to a lower marginal portion of said minor compartment.

6. The handbag according to claim 5 wherein said credit card holding means comprises a credit card holder having a pair of panels positioned in face-to-face relation and attached to each other along marginal portions thereof, each panel defining a plurality of adjacent slits for reception of a corresponding plurality of credit cards.

7. The handbag according to claim 6 wherein each of said slits is associated with a fabric pocket extending therebelow for reception and support of at least a portion of a respective credit card.

8. The handbag according to claim 7 wherein each of said panels of said credit card holder comprises a synthetic or natural leather material.

9. The handbag according to claim 8 wherein each adjacent pair of said slits of said panels of said credit card holder defines a corresponding synthetic or natural leather material strip which separate credit cards inserted therein from each other.

10. The handbag according to claim 9 wherein each of said panels of said credit card holder comprises at least five adjacent parallel material strips defined by four of said parallel slits, each adjacent pair of said material strips having associated therewith one of said fabric pockets.

11. The handbag according to claim 10 wherein each of said panels are stitched together along marginal edge portions thereof.

12. The handbag according to claim 11 wherein each said fabric pocket is formed of a material portion attached to rear surface portions of adjacent synthetic or natural leather material strips.

13. The handbag according to claim 12 wherein each said pocket is comprised of a fabric liner material and extends downwardly from a rear surface portion of a synthetic or natural leather material strip and is folded to extend upwardly to a rear surface portion of the next lower material strip to form said credit card receiving pocket.

14. The handbag according to claim 13 wherein said fabric connector is attached to said pair of panels by stitches at a lower marginal portion thereof, and said connector is attached at the opposite end to a lower portion of said minor compartment by stitches.

15. The handbag according to claim 14 wherein said minor compartment subdivides said major compartment into two separate compartments for receiving and retaining articles.

16. The handbag according to claim 15 further comprising a closure flap extending from an upper marginal portion of said rear wall and dimensioned for selective movement over an access opening of said major compartment, said flap having means for releasable attachment thereof to an opposite wall portion so as to protectively cover said access opening of said major compartment.

17. The handbag according to claim 16 further comprising a second compartment attached to said front wall portion and structured and adapted for reception of articles.

18. A handbag which comprises an enclosure having opposed front and rear wall portions, opposed side wall portions, and a bottom wall portion defining a major compartment having an opening at the top thereof for gaining access thereinto, the major compartment being subdivided into at least first and second storage regions by a minor compartment within said major compartment and extending thereacross, said minor compartment being adapted for reception of a credit card holder and being formed by at least two panels positioned in opposed face-to-face relation, said panels being attached along at least portions of their upper margins, and unattached over a marginal portion having a dimension equal to or sufficiently greater than a corresponding dimension of said credit card holder to permit insertion of said credit card holder therebetween in snug relation therewith, said credit card holder having a dimension less than a corresponding dimension of said major compartment when positioned in said minor compartment, and being formed of adjacent panels attached to each other in face-to-face relation, each panel having a plurality of slits for reception of at least one associated credit card, each said slit having associated therewith a fabric pocket for reception and support of such credit card, said credit card holder being attached to said minor compartment by a fabric connector of predetermined length, said fabric connector having two end portions and being attached at one end portion to a lower marginal portion of said credit card holder and at the other end portion to a lower portion of said minor compartment, said fabric connector further having a widthwise dimension less than a corresponding dimension of said credit card holder, whereby said credit card holder can be removably inserted into said minor compartment and selectively moved upwardly with respect to said minor compartment a limited distance defined by the length of said fabric connector thereby preventing permanent separation of said credit card holder from said enclosure and said credit card holder may be selectively inserted into said minor compartment whereby said fabric connector may assume a folded condition in a limited space within said minor compartment.

19. A handbag which comprises an enclosure formed of natural or synthetic leather and having opposed front and rear wall portions, opposed side wall portions, and a bottom wall portion defining a major compartment having an opening at the top thereof for gaining access thereinto, the major compartment being subdivided into at least first and second storage regions by a minor compartment within said major compartment and extending thereacross, said minor compartment being formed by at least two panels positioned in opposed face-to-face relation, said panels being attached at least along two upper marginal portions, and unattached over a marginal portion positioned between said first mentioned two upper marginal portions to define said minor compartment, a credit card holder positionable within said minor compartment, said credit card holder being comprised of adjacent panels attached to each other in face-to-face relation, each panel having a plurality of slits, each slit for reception of a credit card, each said slit having associated therewith a fabric pocket for reception and support of the credit card, a fabric connector of predetermined length and having a width less than the corresponding dimension of said credit card holder, said fabric connector being attached at one end portion to a lower marginal portion of said credit card holder and at the other end portion to a lower end portion of said minor compartment, whereby said credit card holder can be inserted into said minor compartment while permitting said fabric connector to assume a folded condition in a limited space within said minor compartment, and selectively separated from a fully inserted position from said minor compartment up to a limited distance defined by the length of said fabric connector thereby preventing permanent separation of said credit card holder from said enclosure.

20. The handbag according to claim 19 further comprising means to provide closure of said opening of said major compartment.

21. The handbag according to claim 20 wherein said means to provide closure of said opening of said major compartment comprises a closure flap extending from said rear wall portion across said opening and releasably attachable to a front wall portion to provide releasable closure for said opening.

22. The handbag according to claim 20 further comprising an additional compartment attached to said front wall portion and structured and adapted for reception of articles, said additional compartment having a front wall portion having closure means thereon for attachment by closure means on said closure flap whereby said closure flap extends over said major compartment and said minor compartment and is attachable to a front wall.

23. A handbag which comprises an enclosure defining a major compartment for receiving and retaining articles, a minor compartment within said major compartment, said minor compartment being formed by at least two panels positioned in opposed face-to-face relation, said panels being attached at least along two upper marginal portions, and unattached over a marginal portion positioned between said two upper marginal portions to define said minor compartment, a credit card holder for holding at least one credit card, said credit card holder positionable in snug relation within said minor compartment between said at least two panels and removable therefrom, and a connecting member for attaching said credit card holder with respect to said minor compartment in a manner which permits insertion of said credit card holder into said minor compartment and withdrawal of said credit card holder upwardly with respect to said minor compartment up to a predetermined distance with respect thereto as limited by said connecting member, to provide user access to said credit card holder, while preventing outward movement of said credit card holder from said minor compartment a distance greater than said predetermined distance, said connecting member having a widthwise dimension less than a corresponding dimension of said credit card holder to thereby conserve space within said minor compartment.

* * * * *